US005117535A

United States Patent [19]

Fehrer

[11] Patent Number: 5,117,535

[45] Date of Patent: Jun. 2, 1992

[54] PROCESS AND APPARATUS FOR PRODUCING A NONWOVEN WEB

[76] Inventor: Ernst Fehrer, Auf der Gugl 28, A-4020 Linz, Austria

[21] Appl. No.: 651,782

[22] Filed: Feb. 7, 1991

[30] Foreign Application Priority Data

Feb. 12, 1990 [AT] Austria ..... 309/90
Mar. 5, 1990 [AT] Austria ..... 511/90
Sep. 11, 1990 [AT] Austria ..... 1842/90

[51] Int. Cl.[5] ..... D01G 15/26

[52] U.S. Cl. ..... 19/99; 19/145.7; 19/296; 19/302

[58] Field of Search ..... 19/98, 99, 145.7, 296, 19/302, 304, 305

[56] References Cited

U.S. PATENT DOCUMENTS 2,913,365 11/1959 Osborne et al. ..... 19/302
3,894,315 7/1975 Fukuta et al. ..... 19/296
4,130,915 12/1978 Gotchel et al. ..... 19/304
4,534,086 8/1985 Fehrer ..... 19/302
4,583,267 4/1986 Fehrer ..... 19/302
4,706,338 11/1987 Anspach ..... 19/302
4,799,294 1/1989 Fehrer ..... 19/99
4,972,551 11/1990 Fehrer ..... 19/302
5,007,137 4/1991 Graute ..... 19/304

*Primary Examiner*—Werner H. Schroeder
*Assistant Examiner*—Michael A. Neas
*Attorney, Agent, or Firm*—Collard, Roe & Galgano

[57] ABSTRACT

For the production of a nonwoven web from a primary nonwoven web a conventional carding drum is used as well as a collecting surface, on which a vacuum is applied and which is continuously moved and serves to collect the fibers flying from the carding drum. In order to ensure desirable conditions for the entrainment of the fibers flying off, the fibrous covering on the carding drum is sucked from consecutive layers on consecutive portions of the surface of the drum so as to from partial streams of fibers in suction passages between the carding drum and the collecting surface.

11 Claims, 3 Drawing Sheets

PROCESS AND APPARATUS FOR PRODUCING A NONWOVEN WEB

BACKGROUND OF THE INVENTION

1. Field of the Invention

This invention relates to a process of producing a nonwoven web from a primary nonwoven web, which is disintegrated into individual fibers and is then caused to form a fibrous covering on a rotating drum and is subsequently caused to form at least one stream of fibers, which in an entraining air stream is applied to a continuously moving collecting surface, through which the entraining air stream is sucked off, and to an apparatus for carrying out the process.

2. Description of the Prior Art

In order to produce a nonwoven web from a primary nonwoven web it is known (U.S. Pat. No. 3,641,628) to feed the primary nonwoven web via a feeding trough to a carding drum, by which said web is disintegrated into individual fibers and which cooperates with pairs of worker and clearer rollers to equalize said individual fibers, whereafter the covering composed of the individual fibers is separated from said drum by the action of centrifugal force and by the action of an entraining air stream which is tangential to the carding drum. In order to form the nonwoven web the individual fibers are deposited on a collecting surface, which is disposed below the carding drum and is continuously moved and the entraining air stream is sucked through said collecting surface. Whereas the carding operation and the equalization of the dissolved nonwoven web by the pairs of worker and clearer rollers can be performed so that a substantially uniform covering composed of individual fibers is prepared at the point where the fibers are separated from the carding drum, such known apparatuses cannot be used for the production of uniform nonwoven webs at a relatively high fiber rate because an increase of the number of fibers which are to be separated from the carding drum per unit of time will increase the tendency of said fibers to form knots and this will be undesirable particularly in nonwoven webs which are light in weight. Besides, the length of the flight path for the fibers from the region in which they separate from the carding drum and the region in which they impinge on the collecting surface extending below the carding drum will necessarily depend on the diameter of the carding drum so that the entraining air must flow over relatively long distances particularly if the working widths are large so that the carding drums must be relatively large in diameter for ensuring the required strength. But such long flow paths for the entraining air will also increase the tendency to form knots.

In order to avoid those disadvantages which relate to the separation of the fibers from the carding drum it is possible to decrease the fiber density of the stream of fibers flying from the carding drum. From U.S. Pat. No. 4,583,267 it is known that for that purpose a plurality of closely spaced apart, consecutive carding drums may be provided so that each succeeding carding drum acts like a worker roller to comb out the fibrous material which has been fed by the next preceding carding drum. In that case only part of the fibrous covering on the next preceding carding drum is ejected through the nip between the carding drums onto the collecting surface and the fibrous covering is thus divided into a plurality of streams of fibers, which consecutively fly from respective carding drums and are deposited on a collecting surface, on which a vacuum is applied. That practice will not only ensure a substantially undisturbed transfer of the individual fibers from each carding drum to the collecting surface because the density of the fibers in the streams of fibers is limited, but will also ensure an equalization if irregularities occur in the distribution of fibers. The nonwoven web is built up on the collecting surface from the several streams of fibers, which consecutively impinge on the collecting surface at locations which succeed each other in the direction of travel of the collecting surface. But that desirable formation of the nonwoven web requires a higher structural expenditure because a plurality of carding drums must be arranged one behind the other and irregularities will inevitably occur as a part of the fibrous material is taken over by a succeeding carding drum and requires an equalization by additional pairs of worker and clearer rollers. Besides, the distance from the nip between two consecutive carding drums to the collecting surface will depend on the drum diameter and the use of drums which are larger in diameter will increase the tendency to form knots.

SUMMARY OF THE INVENTION

For this reason it is an object of the invention to provide for the production of a nonwoven web a process which is of the kind described first hereinbefore and in which a separation of the fibers from a carding drum under favorable conditions is ensured and a formation of knots by the fibers as they are entrained by air over long distances will be avoided.

The object set forth is accomplished in accordance with the invention in that the fibrous covering on the drum is sucked from the drum in a direction which is transverse to the surface of the drum.

As a result, the fibrous covering is sucked from the drum in an at least approximately radial direction so that the distance over which the fibers are entrained by the air will be independent from the drum diameter and can be selected in view of the requirements to be met in each case and even if the drums are large in diameter the average length of the flight paths for the fibers may be so small that no knots will be formed by the fibers. Besides, the removal of fibers from the drum will gradually proceed over the thickness of the fibrous covering so that the separation of individual fibers from the drum will be assisted. Because the fibers are sucked from the surface of the drum in a substantially radial direction, the collecting surface extends at least approximately parallel to the region from which the fibers separate so that, contrary to a tangential separation of the fibers, the fibers will be scattered on the collecting surface over a relatively large area and, as a result, any irregularities in the distribution of fibers will be equalized to a higher degree.

According to a further feature of the invention, particularly desirable conditions will be obtained in that a plurality of streams of fibers are formed in that consecutive layers of the fibrous covering on the drum are sucked from consecutive portions of the drum in directions which are transverse to the surface of the drum. Because individual fibers are initially sucked from an outer layer of the fibrous covering on a portion of the peripheral surface of the drum that stream of fibers which have been sucked off can readily be subjected to conditions which regarding a restriction of the density of fibers are desirable for an undisturbed entraining of the fibers by the air stream. This is also applicable to the sucking of additional streams of fibers from subsequent layers on consecutive portions of the periphery of the drum so that the covering composed of individual fibers on the drum can be removed in a plurality of streams of fibers without a formation of knots and can be applied to a continuously moved collecting surface at locations arranged one behind the other in the direction of travel and this can be achieved without a need for additional carding drums. As a result, the disturbing influences can be avoided which will be inevitable if the fibrous material is transferred from a carding drum to a succeeding carding drum. The doubling effect which is required for an equalization of any irregularities in the distribution of fibers will be ensured because the nonwoven web is composed of a plurality of layers formed by respective streams of fibers just as in a process in which a plurality of carding drums are used to form respective streams of fibers.

In the process in accordance with the invention a plurality of streams of fibers can be sucked from a fibrous covering on any drum on which such a covering of individual fibers can be provided. But it will generally be recommendable not to use for that purpose a drum which is separate from the carding drum so that irregularities which might occur as the fibrous covering is transferred between the drums will be avoided. For this reason the process may desirably be carried out by an apparatus that comprises a carding drum, an air-permeable collecting surface, which is continuously moved and serves to collect the fibers which fly in at least one entraining air stream from the carding drum, at least one suction box, which adjoins the collecting surface and is disposed on that side of the collecting surface that is opposite to the carding drum and at least one suction duct extending between the carding drum and the collecting surface, wherein the suction duct adjoins the carding drum and is at least approximately radial thereto. Because a flow through the suction duct is induced by the suction box, an entraining air stream is formed in the suction duct and that air stream results in a progressive removal of fibers from the fibrous covering on the carding drum so that the fibers which have been sucked off are substantially individually deposited on the collecting surface without having a preferential direction.

For the production of a nonwoven web composed of random fibers having no preferential direction it is essential that the fibers flying from the carding drum to the collecting surface will not be subjected to aligning forces by the entraining air stream. For this reason the entraining air stream must not be accelerated toward the collecting surface. That requirement can desirably be met by the provision of the suction duct which adjoins the periphery of the carding drum because the flow conditions in that suction duct may be determined by relatively simple structure. On the other hand, a short length may be selected for the suction duct regardless of the diameter of the carding drum so that considerable advantages over comparable known apparatuses are afforded.

To separate the fibrous covering from the carding drum in a plurality of streams of fibers it will be sufficient to provide between the carding drum and the collecting surface a plurality of suction passages, which are arranged one behind the other in the peripheral direction of the carding drum and in the direction of movement of the collecting surface and which adjoin the carding drum and adjacent to said drum extend at least approximately radially thereto so that each stream of fibers in the associated suction passage will benefit from the advantages afforded by a radial sucking of the fibers and it will be possible to build up a nonwoven web composed of a plurality of layers.

To ensure that proper conditions of flow will be established in each suction passage, air at a sufficiently high rate must be available for the entraining air stream. For that purpose each suction passage may communicate adjacent to the carding drum with at least one air intake opening. Air at the rate which is required for an undisturbed entraining of fibers can be sucked through said air intake openings. The provision of the air intake openings leading to the suction passages adjacent to the carding drum will cause the air stream to be deflected in the direction of the suction passages close to the carding drum so that it will be ensured that the fibers which have been separated from the carding drum will be entrained further by the entraining air stream without a disturbance.

In that context, particularly desirable conditions will be obtained if the air intake openings are at least provided in those passage-defining walls which are leading walls with respect to the sense of rotation of the carding drum because in that case the entraining air stream which is formed adjacent to the periphery of the carding drum will assist the separation of the individual fibers from the carding drum.

The air intake openings leading to the suction passages are intended to ensure a uniform distribution of the entraining air over the working width of the carding drum. To that end the air intake openings may consist, e.g., of rows of individual nozzles. A particularly simple design will be obtained if the air intake openings consist of intake slots, which extend continuously over the width of the carding drum. It has surprisingly been found that a sufficiently uniform distribution of the fresh air can be achieved by the provision of such relatively narrow intake slots even over a relatively large working width.

Separate air lines might be provided for supplying fresh air to the air intake openings. But the space between the walls defining the suction passages may desirably be utilized as a fresh air passage so that such fresh air passages will be defined by the side walls defining the passages and the covering means provided between said side walls adjacent to the carding drums and adjacent to the collecting surface.

To ensure that the uniformity of the nonwoven web as regards the distribution and alignment of fibers will not adversely be affected as the nonwoven web is delivered from the apparatus the collecting surface is desirably constituted by a portion of a conveyor for delivering the nonwoven fabric so that it is no longer necessary to transfer nonwoven web from the collecting surface to a separate delivery conveyor. Because a vacuum is applied on the collecting surface that collecting surface may extend in a plurality of orientations in dependence on the space which is available. To avoid the need for applying a vacuum throughout the delivering conveyor, the conveying course of the delivering conveyor belt may extend substantially horizontally at least outside that portion which constitutes the collecting surface that adjoins the suction ducts.

DETAILED DESCRIPTION OF THE PREFERRED EMBODIMENTS

Figure 1:
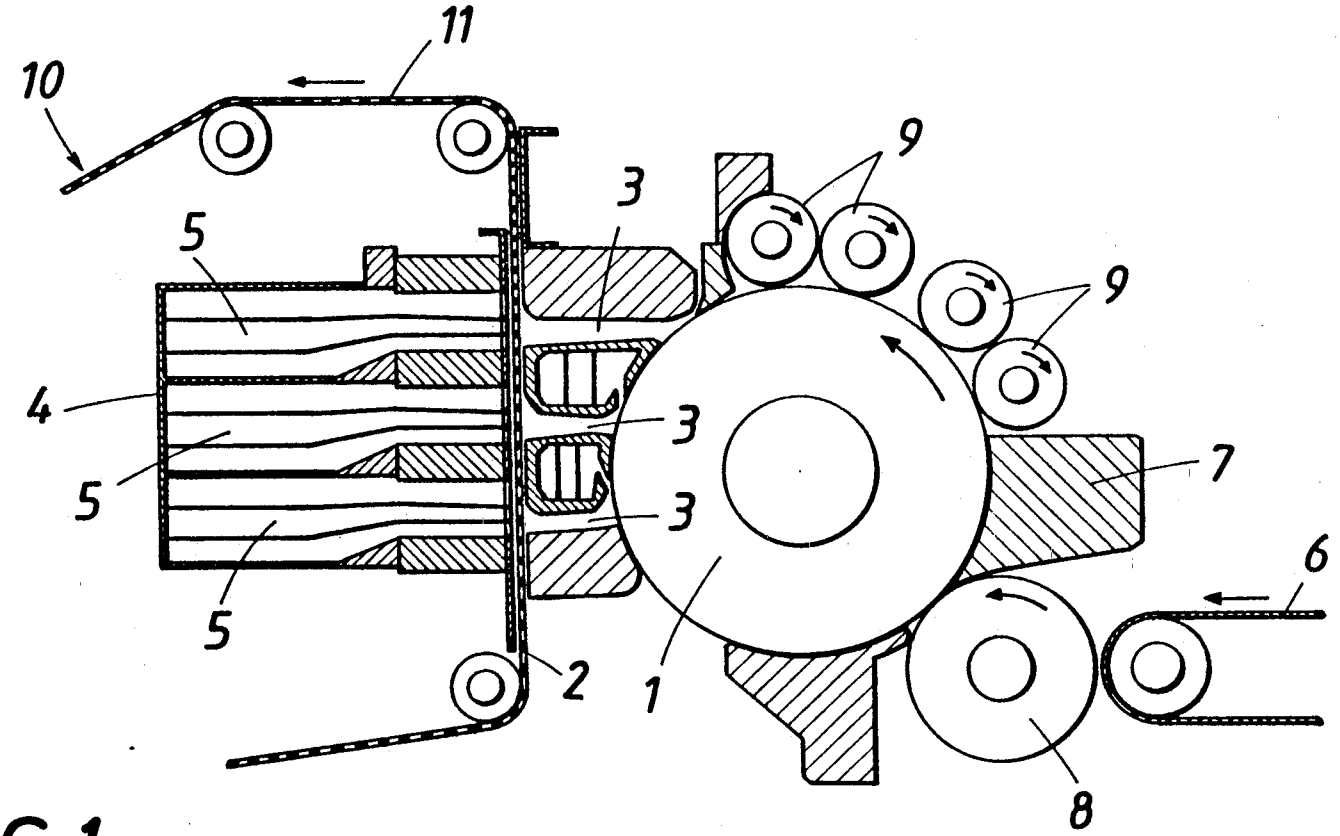
FIG. 1 is a diagrammatic transverse sectional view showing an apparatus in accordance with the invention for producing a nonwoven web.

The production process in accordance with the invention will be described more in detail with reference to the drawing. In accordance with FIGS. 1 and 2 the illustrated apparatus for producing a nonwoven web from a primary nonwoven web essentially comprises a carding drum 1, which is provided with card clothing consisting of teeth. The apparatus also comprises an air-permeable collecting surface 2, which is continuously moved, and a plurality of suction passages 3, which are arranged one behind the other in the peripheral direction of the carding drum 1 and in the direction of travel of the collecting surface 2. Said suction passages 3 are open to the carding drum and adjacent to said drum extend at least approximately radially thereto. A suction box 4 is provided on that side of the collecting surface 2 which is opposite to the carding drum 1 and is provided with suction inserts 5, which are divided by partitions into areas corresponding to the respective suction passages 3 so that a flow through the suction passages 3 is induced by the suction inserts 5.

The initially provided primary nonwoven web is supplied to the carding drum 1 by means of a belt conveyor 6 to a trough feeder, which is associated with the carding drum 1 and consists of a trough deck 7 and a feed roller 8. The primary nonwoven web is disintegrated into individual fibers by the carding drum 1 and by means of pairs 9 of worker and clearer rollers succeeding the trough feeder in the sense of rotation of the carding drum 1 the fibrous covering is additionally equalized. That fibrous covering is then supplied to the suction passages 3, which are consecutively arranged and spaced apart in the peripheral direction. The intake stream through the several suction passages 3 causes the individual fibers to be removed from consecutive layers of the fibrous covering so that said fibers fly freely in several streams of fibers and are consecutively applied to the collecting surface 2. Said streams of fibers are deposited on the collecting surface 2 at locations which succeed each other in the direction of travel of the collecting surface 2 and their fiber density is so low that there is no risk of a formation of disturbing knots of fibers within each stream of fibers, particularly because the entraining length of the suction passages 3 is relatively short. Because the velocity of flow in the suction passages is lower than the velocity of fibers which would tangentially be blown from the carding drum, the fibers will be uniformly deposited on the collecting surface 2 as random fibers having no preferential direction and in spite of a high rate of fibers a very uniform nonwoven web will be formed even if the web is light in weight. The nonwoven web which has been built up is composed of a plurality of fibers and can be taken over by a belt conveyor and carried off for a further processing. But a simpler structure will be obtained if the collecting surface 2 is constituted by a conveying portion of a delivering conveyor belt 10 because in that case the disturbing influences otherwise resulting from the transfer of the nonwoven web from the collecting surface to a delivering conveyor will be avoided. The conveying course 11 of the delivering conveyor belt 10 extends substantially horizontally outside the collecting surface 2 so that no suction will be required at that portion on which a horizontal conveyance is effected. The collecting surface 2 may have any desired orientation, i.e., it may also be horizontal or may be vertical, because the nonwoven web being formed is sucked against the collecting surface.

For a uniform deposition of fibers on the collecting surface 2 it will obviously be necessary that the fibers are entrained in the suction passages 3 without a disturbance and this requires that suitable entraining air streams are generated within the suction passage 3. Because there is a restriction to the intake of air between the carding drum 1 and the means for covering the drum, air intake openings 12 consisting of intake slots are associated with the suction passages 3 adjacent to the carding drum 1 and said slots extend throughout the working width of the carding drum 1. The arrangement is such that the air intake openings 12 are formed in those passage-defining walls 13 which are the leading walls with respect to the sense of rotation of the drum so that the air streams which have flown through said intake openings will be deflected to the direction of the suction passages 3 and will thus assist the separation of fibers from the carding drum 1.

Figure 2:
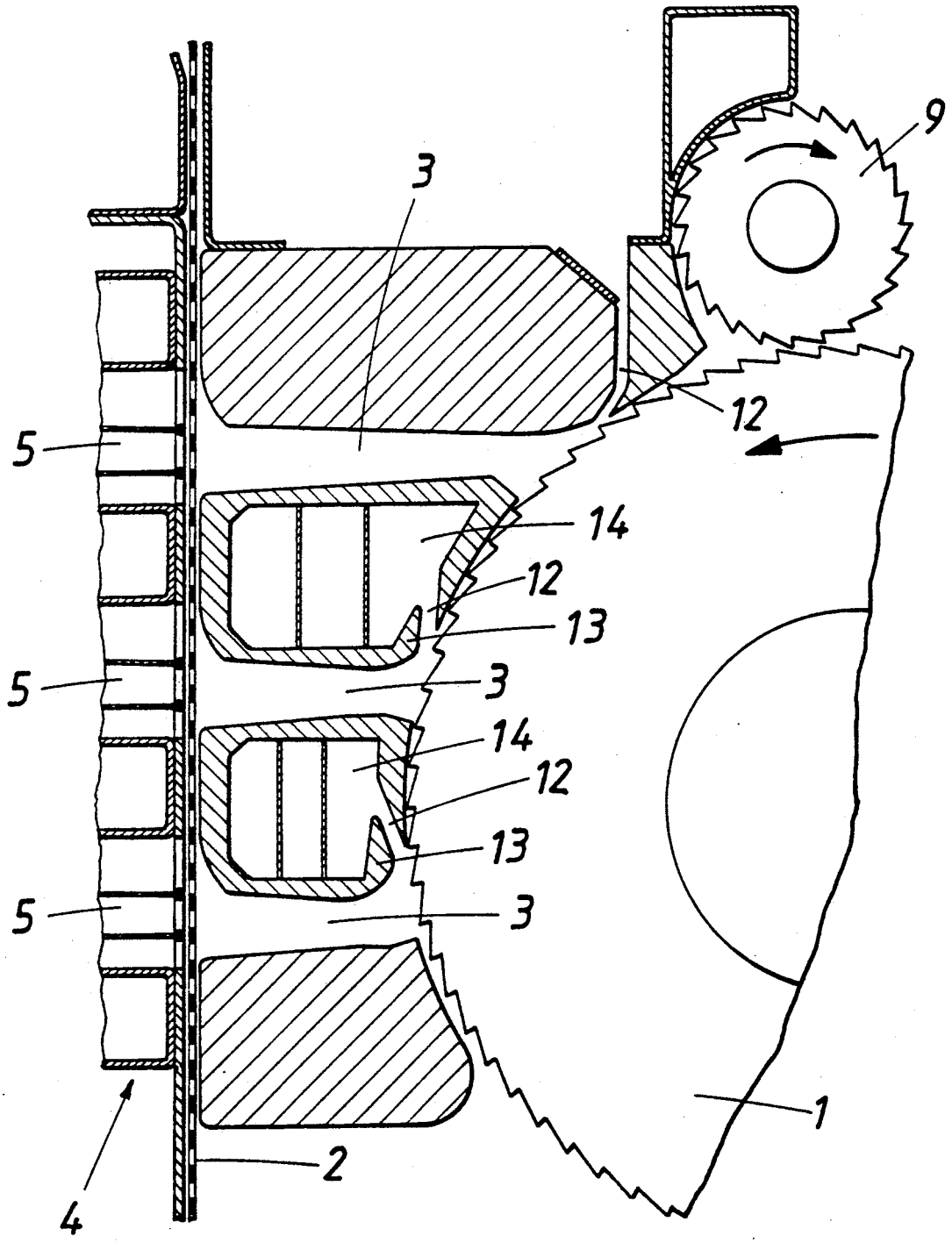
FIG. 2 is a sectional view showing on a larger scale a portion of the apparatus in a view on the suction passages.

As is particularly apparent from FIG. 2, a passage 14 is formed between the side walls defining the suction passages and the covering means which are provided between said passage-defining walls and the carding drum 1 and said passage 14 can desirably be utilized as an air intake passage leading to the air intake openings 12. In that case the covering means adjacent to the drum constitute the side walls 13 which define the suction passages and are provided with the air intake openings 12.

Figure 3:
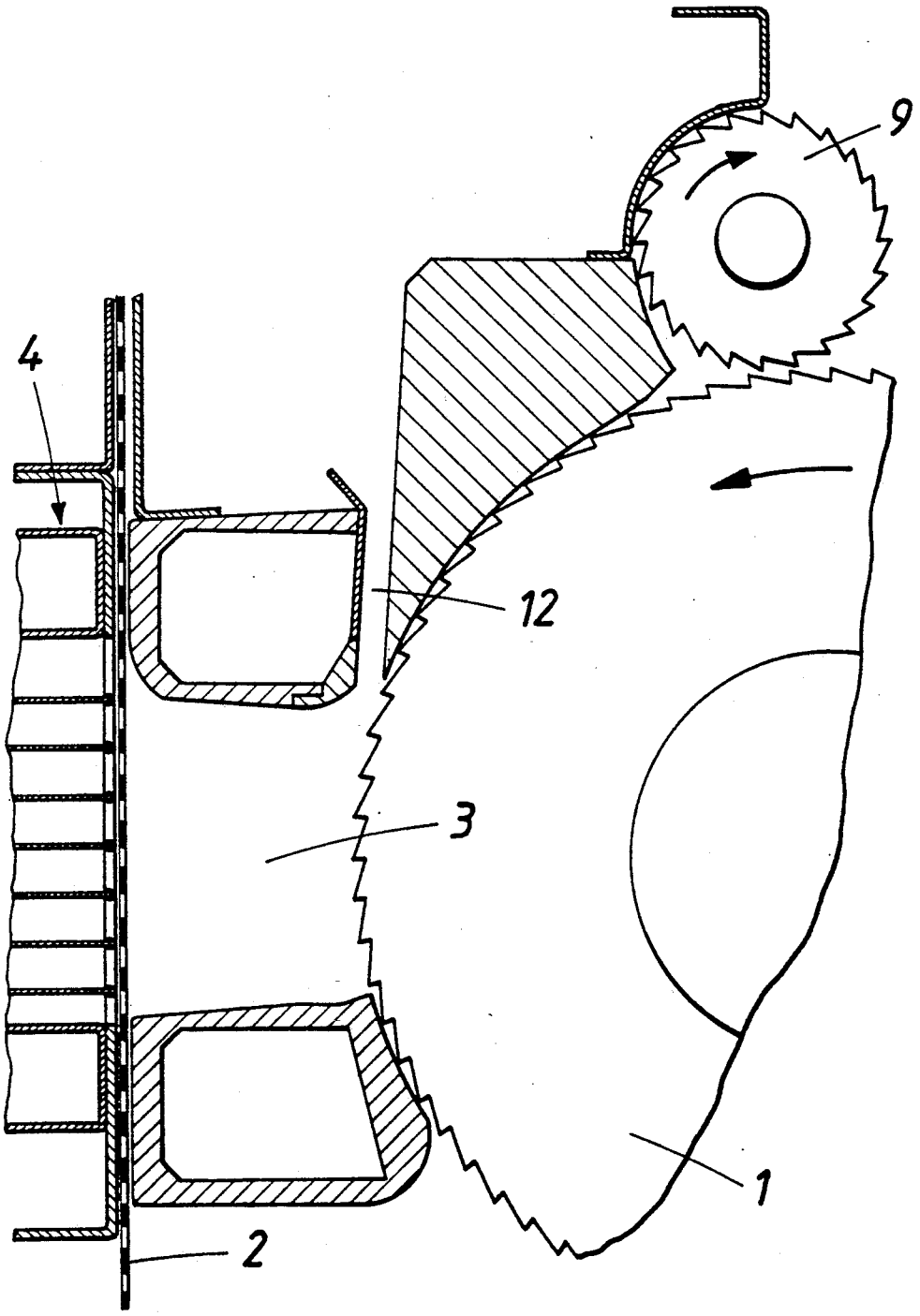
FIG. 3 is a view that is similar to FIG. 2 and shows a simplified embodiment of an apparatus in accordance with the invention.

FIG. 3 shows a simplified design of an apparatus in accordance with the invention. Instead of three suction passages, only one suction passage 3 is provided between the carding drum 1 and the collecting surface 2. As is clearly apparent from the drawing the length in which that suction passage extends radially to the carding drum 1 may be selected regardless of the diameter of the carding drum 1 so that the free length of the path on which the individual fibers which have been separated from the carding drum fly freely may be selected in dependence on the requirements in each case. Because the width of the suction passage 3 is adapted to the peripheral length of the region in which the fibers separate from the carding drum 1, the fibrous covering will progressively be sucked from the carding drum through the thickness of that fibrous covering so that compared to a tangential sucking of fibers the advantage will be afforded that the fibers will be scattered over a much larger length and, owing to the lower density of fibers in the entraining air stream, there will be only a small tendency of the fibers to form knots.

I claim:

1. In a process of producing a nonwoven web from a primary nonwoven web, comprising depositing said primary web on a peripheral surface of a rotating drum and disintegratng said primary web into individual fibers to form on said peripheral surface a fibrous covering, continuously moving an air-permeable collecting surface past said peripheral surface.

sucking at least one air stream through said collecting surface to a side of said collecting surface which is opposite to said drum to cause said at least one air stream to suck fibers from said peipheral surface of said drum and to entrain said fibers in said at least one stream of fibers to said collecting surface, and collecting said fibers entrained in said at least one air stream on said collecting surface, the improvement comprising entraining said fibers by said at least one air stream from said peripheral surface in a substantially radial direction which is transverse to a portion of said peripheral surface intersected by said at least one air stream.

2. The improvement set forth in claim 1 wherein a plurality of said air streams are sucked through said collecting surface to the side of said collecting surface which is opposite to said drum to cause said air streams to suck fibers from peripherally consecutive portions of said peripheral surface of said drum and to entrain said fibers in a plurality of streams of fibers to said collecting surface.

3. In an apparatus for producing a nonwoven web from a primary nonwoven web, comprising a rotatable drum having a peripheral surface and adapted to support on said surface a covering composed of individual fibers, means providing an air-permeable collecting surface which is movable past said peripheral surface in a predetermined direction of travel, suction duct means defining at least one suction passage which is open to said peripheral surface and extends from said peripheral surface toward and is open to said collecting surface, means disposed on a side of said collecting surface which is opposite to said drum and operable to suck at least one air stream through said suction duct means and through said collecting surface to suck fibers from said peripheral surface and to entrain said fibers in at least one stream of fibers flowing through said suction duct means to said collecting surface, whereby said fibers entrained by said at least one air stream are collected on said collecting surface, the improvement residing in that said at least one suction passage extends from to said peripheral surface substantially radially with respect to said peripheral surface.

4. The improvement set forth in claim 3 wherein said rotating drum consists of a carding drum for disintegrating a primary nonwoven web into individual fibers and said means for sucking said at least one air stream consists of suction box means disposed on the side of said collecting surface which is opposite to said drum.

5. The improvement set forth in claim 3, wherein said suction duct means defines a plurality of suction passages, which are open to respective peripherally consecutive portions of said peripheral surface of said drum and are open to said collecting surface at portions thereof which succeed each other in said direction of travel.

6. The improvement set forth in claim 3, wherein said suction duct means is formed with at least one air intake opening leading to each of said suction passages adjacent to said peripheral surface of said drum.

7. The improvement set forth in claim 6, wherein said drum is operable to rotate in a predetermined sense, said suction means has adjacent to said peripheral surface of said drum a plurality of walls defining respective ones of said suction passages therebetween, and each wall defines a respective one of said air intake openings on a leading side of a respective one of said suction passages in said predetermined sense.

8. The improvement set forth in claim 6, wherein said drum is adapted to support said fibrous covering on said peripheral surface in a predetermined working width and each of said air intake openings consists of a slot which extends through said working width.

9. The improvement set forth in claim 6, wherein said suction duct means comprises side walls extending from said peripheral surface toward said collecting surface and defining said suction passages and formed with air intake passages communicating with said air intake openings.

10. The improvement set forth in claim 3, wherein said collecting surface is constituted by a length portion of a conveyor belt for delivering the nonwoven web which has been produced.

11. The improvement set forth in claim 10, wherein said belt conveyor comprises a conveying course that comprises said collecting surface and a substantially horizontal length portion for receiving said nonwoven web from said collecting surface.

* * * * *